US007260862B1

(12) United States Patent
DeFilippis

(10) Patent No.: US 7,260,862 B1
(45) Date of Patent: Aug. 28, 2007

(54) BABY BOTTLE AND NIPPLE CLEANING APPARATUS

(76) Inventor: Tina DeFilippis, 63 Burling Lane N., West Islip, NY (US) 11795

( * ) Notice: Subject to any disclaimer, the term of this patent is extended or adjusted under 35 U.S.C. 154(b) by 0 days.

(21) Appl. No.: 11/225,632

(22) Filed: Sep. 12, 2005

(51) Int. Cl.
*A61C 17/22* (2006.01)

(52) U.S. Cl. ..... 15/22.1; 601/142

(58) Field of Classification Search ..... 15/23, 15/22.1, 22.2, 22.3, 22.4, 24, 28, 29, 105; 16/426, 430; D4/129; 601/142
See application file for complete search history.

(56) References Cited

U.S. PATENT DOCUMENTS

| | | | | | |
|---|---|---|---|---|---|
| 2,379,049 | A * | 6/1945 | Tompkins | 15/22.1 |
| 2,911,660 | A | 11/1959 | Klemas et al. | |
| 3,026,552 | A | 3/1962 | Price | |
| 3,138,813 | A * | 6/1964 | Kaplan | 15/22.1 |
| 3,370,214 | A * | 2/1968 | Aymar | 320/115 |
| 3,661,018 | A * | 5/1972 | Keefer et al. | 74/22 R |
| 4,175,299 | A * | 11/1979 | Teague et al. | 15/22.1 |
| 4,237,570 | A | 12/1980 | Brock | |
| 4,397,055 | A * | 8/1983 | Cuchiara | 15/22.1 |
| 4,724,563 | A | 2/1988 | Fry | |
| 5,423,102 | A * | 6/1995 | Madison | 15/22.2 |
| 5,471,695 | A | 12/1995 | Aiyar | |
| 5,488,747 | A * | 2/1996 | Woodhouse | 15/23 |
| 5,636,400 | A | 6/1997 | Young | |
| 5,682,637 | A | 11/1997 | O'Brien | |
| 5,833,014 | A | 11/1998 | Dunn | |
| 6,170,107 | B1 | 1/2001 | George et al. | |
| 6,199,239 | B1 * | 3/2001 | Dickerson | 15/105 |
| 6,202,247 | B1 | 3/2001 | Lorenz, Jr. | |
| 6,289,546 | B1 * | 9/2001 | Harada | 15/167.1 |
| 6,295,681 | B1 | 10/2001 | Dolah | |
| 6,349,443 | B1 | 2/2002 | Randolph et al. | |
| 6,453,498 | B1 * | 9/2002 | Wu | 15/22.1 |
| 2002/0120991 | A1 * | 9/2002 | Cacka et al. | 15/22.1 |
| 2004/0074025 | A1 * | 4/2004 | Blaustein et al. | 15/23 |
| 2004/0107523 | A1 * | 6/2004 | Davies et al. | 15/143.1 |

* cited by examiner

*Primary Examiner*—Gary K. Graham
(74) *Attorney, Agent, or Firm*—Michael I. Kroll

(57) ABSTRACT

Apparatus 10 discloses a baby bottle 44 and nipple 46 cleaner having a plurality of interchangeable brush members 14 that attach to an electrically operated handle 12 that serves to oscillate or rotate the brushes to more effectively remove debris from the object being cleaned. Other brush attachments may be adapted for cleaning other objects such as dishes and the like. Apparatus 10 may be available in any number of colors such as child friendly soft pastels. Decorative figures such as teddy bears 52, clowns, cartoon characters and the like may also adorn the handle 12 and/or charger 48.

9 Claims, 11 Drawing Sheets

BABY BOTTLE AND NIPPLE CLEANING APPARATUS

BACKGROUND OF THE INVENTION

1. Field of the Invention

The present invention relates generally to baby bottle cleaning brushes and, more specifically, to a baby bottle and nipple cleaning apparatus having a plurality of interchangeable brush members that attach to an electrically operated handle that serves to oscillate or rotate the brushes to more effectively remove debris from the object being cleaned. Other brush attachments may be adapted for cleaning other objects such as dishes and the like.

The present invention may be available in any number of colors such as child friendly soft pastels. Decorative figures such as teddy bears, clowns, cartoon characters and the like may also adorn the handle and/or charger.

2. Description of the Prior Art

There are other brushes designed for cleaning. Typical of these is U.S. Pat. No. 2,911,660 issued to S. Klemas et al on Nov. 10, 1959.

Another patent was issued to J. C. Price on Mar. 27, 1962 as U.S. Pat. No. 3,026,552. Yet another U.S. Pat. No. 4,237,570 was issued to W. B. Brock, Jr. on Dec. 9, 1980 and still yet another was issued on Feb. 16, 1988 to R. A. Fry et al. as U.S. Pat. No. 4,724,563.

Another patent was issued to S. Aiyar on Dec. 5, 1995 as U.S. Pat. No. 5,471,695. Yet another U.S. Pat. No. 5,636,400 was issued to K. L. Young on Jun. 10, 1997. Another was issued to G. A. O'Brien on Nov. 4, 1997 as U.S. Pat. No. 5,682,637 and still yet another was issued on Nov. 10, 1998 to H. Dunn as U.S. Pat. No. 5,833,014.

Another patent was issued to D. T. George et al. on Jan. 9, 2001 as U.S. Pat. No. 6,170,107. Yet another U.S. Pat. No. 6,202,247 was issued to M. A. Lorenz, Jr. on Mar. 20, 2001. Another was issued to O. H. Dolah on Oct. 2, 2001 as U.S. Pat. No. 6,295,681 and still yet another was issued on Feb. 26, 2002 to R. S. Randolph et al as U.S. Pat. No. 6,349,443.

U.S. Pat. No. 2,911,660

Inventor: Seymour Klemas et al.

Issued: Nov. 10, 1959

In a motor operated toothbrush, an elongated housing having a head portion and a handle portion disposed at right angles to each other, said head portion extending from an extremity of the handle portion, in combination with a neck formed of flexible material, said neck including an inner flange adapted for removable connection with the head portion where it extends beyond the perimeter of the handle portion, said neck portion being normally axially aligned with the head portion forming a hollow tubular extension thereto adapted to receive a Flexible operating shaft from a motor adapted to be mounted within the head portion.

U.S. Pat. No. 3,026,552

Inventor: Joseph C. Price

Issued: Mar. 27, 1962

A scouring device for cooking utensils and the like comprising a motor, a shaft rotatably driven by the motor at one end thereof, the motor and the shaft being of a size suitable for manual manipulation, a brush-supporting disc on the other end of the shaft remote from the motor, a wire brush of flexibly-resilient fibers arranged in truncated conical form and having its narrower end secured to one face of the disc, those fibers of the brush which are adjacent to the periphery of the brush being flared outwardly and downwardly, a flexible polishing pad formed from randomly oriented fibers penetrable by the ends of said brush fibers.

U.S. Pat. No. 4,237,570

Inventor: William B. Brock

Issued: Dec. 9, 1980

A power brush apparatus for use in cleaning airplanes or the like which includes an elongate hollow handle with a drive member coaxially mounted and journaled within the hollow handle and which drive member is connected at one end to a drive motor in a driving connection and at the opposite end to a stub shaft arranged in a housing at an angle of about 45.degree. with respect to the longitudinal length of the handle and a brush of the rotatable type is secured for rotation to the terminal end of the stub shaft.

U.S. Pat. No. 4,724,563

Inventor: Raymond A. Fry

Issued: Feb. 16, 1988

A personal care powered scrub brush apparatus and recharging arrangement that uses a waterproof housing. The scrub brush apparatus is specially shaped to allow one to easily use the device and allow proper seating within a recharging cradle having contours which mate with the periphery of a head portion of the apparatus. The recharging cradle uses contacts which are spring-biased by the leaf spring operation of the contacts themselves in order to assure proper electrical contact for recharging of batteries within the scrub brush apparatus. The cradle further includes a floor slanted to a drip tube which allows water to flow to a removable basin such that the scrub brush may be placed upon the cradle for recharging with the brush in place and without waiting for the brush to dry.

U.S. Pat. No. 5,471,695

Inventor: Sanjay Aiyar

Issued: Dec. 5, 1995

A motorized brush imparts vibrational motion to a scrubbing brush head. The brush includes a water-tight housing, in which a small electric motor is mounted. The motor includes an eccentric weight mounted to its drive shaft. In use, the motor is energized, causing the eccentric weight to be rotated. The eccentric weight vibrates the brush head without rotating it. This vibrational motion provides an effective scrubbing action without the necessity for complex sealing mechanisms connecting the brush head to the motor shaft.

U.S. Pat. No. 5,636,400

Inventor: Keenan L. Young

Issued: Jun. 10, 1997

An automatic infant bottle cleaner comprises a hand-held, battery-operated drill mechanism having a bristle brush attachment. The drill mechanism has an ergonomically angled case made of hard plastic. The drill mechanism also has a three position slide switch, a rectifier, two rechargeable batteries, and a small three-volt DC motor. A method of using the cleaner is also provided.

U.S. Pat. No. 5,682,637

Inventor: George A. O'Brien

Issued: Nov. 4, 1977

A window scraper brush is disclosed. The brush has a brush support defining a longitudinal axis and a plurality of filaments extending from a portion of the brush support. The filaments are tapered with the tips of the filaments defining a longitudinal filament edge substantially parallel to the longitudinal axis. Preferably, the brush has brass filaments and an axle about which the brush can be oscillated. The brush preferably includes camming structure cooperable with a housing to cause the brush to move toward and away from a work surface during a portion of each oscillation of the brush about the axle.

U.S. Pat. No. 5,833,014

Inventor: Herbert Dunn

Issued: Nov. 10, 1998

About a rigid longitudinal extension a sleeve is frictionally suspended such that the extension may reciprocate freely within the sleeve while remaining relatively stationary longitudinally. The rear end of the extension is attachable to a reciprocating portable power tool and the forward end is attached to a tool head. In operation, the extension and the tool head reciprocate while the sleeve, grasped in one hand, is frictionally isolated from the reciprocation and consequently insulated from the vibration associated with the operation of a portable reciprocating portable power tool. A coupling upon the forward end of the extension facilitates the attachment of a variety of different tool ends. Frictional suspension of the sleeve about the extension by using a pair of springs or by using bearings between the sleeve and the extension is suggested. A flat platform tool head, primarily for sanding, brush heads and blade heads are also specifically suggested, as is coupling by use of threading and by use of hook and catch.

U.S. Pat. No. 6,170,107

Inventor: Dewey T. George et al.

Issued: Jan. 9, 2001

A rotating brush cleaning apparatus is provided having grippable handle and a plurality of elongated brush attachments. The handle houses a rechargeable battery driven motor that drive an attached brush in a circular rotation. Each brush attachment is mounted on a central, elongated bendable plastic core. A first narrow brush attachment is relatively narrow and adapted to be used for cleaning baby bottles and tall glasses. A narrow brush scrubber attachment comprises and annular ring of rough scouring material that can be placed over the narrow brush attachment for cleaning any caked-on residue at the bottom of a baby bottle or tall glass.

U.S. Pat. No. 6,202,247

Inventor: Michael A. Lorenz, Jr.

Issued: Mar. 20, 2001

An apparatus for cleaning a baby bottle and an artificial nipple includes a handle, a bottle brush head and a nipple brush head. The bottle brush head made of materials creating a multi-action cleansing ability is attached to the handle at a flexible neck for ease of cleaning the interior of a bottle. The bottle brush head may be replaced when worn. The nipple brush head, made of a spongy material, is attached such that it may be moved into a chamber within the handle when not in use, protecting it from contact with foreign surface. The nipple brush head may also be replaced when worn.

U.S. Pat. No. 6,295,681

Inventor: Olga H. Dolah

Issued: Oct. 2, 2001

A rotary brush cleaning device with interchangeable brush attachments including a power unit adapted for being held in a hand of a user. The power unit comprises a housing adapted for being gripped in the hand of a user, and the housing has an interior. A motor is mounted in the interior of the housing. An attachment mounting member is located in the interior of the housing, and a power source is located in the housing. At least one interchangeable brush attachment is provided for removably coupling to the power unit. The brush attachment includes a brush portion and an attachment base portion for removably mounting to the attachment mounting member of the power unit. The attachment mounting member has a mounting groove formed by an inner wall surface and an outer wall surface spaced from the inner wall surface. The mounting groove is substantially annular and peg members are located at diametrically opposite locations on the annular mounting groove. The attachment base portion of the brush attachment has a sleeve portion for insertion into the mounting groove of the attachment mounting member of the power unit. The attachment base portion has an attachment slot for receiving and engaging the peg member of the attachment mounting member. The brush attachments may include a toilet cleaning brush attachment, a bottle cleaning brush attachment, a sponge brush attachment, a baby bottle nipple cleaning brush attachment, a wire brush attachment, and a scouring brush attachment.

U.S. Pat. No. 6,394,443

Inventor: Ross Steven Randolph et al.

Issued: Feb. 26, 2002

A cleaning device has a handle. The handle has a wall with a distal end with a recess extending axially into the handle, and an elongated nipple brush secured in the recess, such that the distal end of the brush extends axially beyond the distal end of the handle. The nipple brush can be housed in a core having a main body with a sponge secured thereto and an extension with opposed depressible tabs that can be inserted into the recess of the handle. Each tab has one or more protuberances that are biased to seat in opposed apertures in the wall of the handle. The core has an axial channel. When the extension of the core is inserted in the recess and attached to the handle, there is provided a cleaning device with a sponge at one end of the handle and a nipple brush housed in the channel of the core.

While these scouring devices may be suitable for the purposes for which they were designed, they would not be as suitable for the purposes of the present invention, as hereinafter described.

SUMMARY OF THE PRESENT INVENTION

The present invention discloses a baby bottle and nipple cleaning apparatus having a plurality of interchangeable brush members that attach to an electrically operated handle that serves to oscillate or rotate the brushes to more effectively remove debris from the object being cleaned. Other brush attachments may be adapted for cleaning other objects such as dishes and the like. The present invention may be available in any number of colors such as child friendly soft pastels. Decorative figures such as teddy bears, clowns, cartoon characters and the like may also adorn the handle and/or charger.

A primary object of the present invention is to provide an electrically operated oscillating or rotating brush apparatus for cleaning baby bottles and nipples.

Another object of the present invention is to provide an electrically operated oscillating or rotating brush apparatus for cleaning baby bottles and nipples having a plurality of interchangeable brush members.

Yet another object of the present invention is to provide an electrically operated oscillating or rotating brush apparatus for cleaning baby bottles and nipples that is rechargeable.

Still yet another object of the present invention is to provide an electrically operated oscillating or rotating brush apparatus for cleaning baby bottles and nipples having a battery charger in which the brush handle stands upright in during recharging.

Another object of the present invention is to provide an electrically operated oscillating or rotating brush apparatus for cleaning baby bottles and nipples that is simple and easy to use.

Still another object of the present invention is to provide an electrically operated oscillating or rotating brush apparatus for cleaning baby bottles and nipples that is inexpensive to manufacture and operate.

Additional objects of the present invention will appear as the description proceeds.

The present invention overcomes the shortcomings of the prior art by providing an electrically operated handle that rapidly vibrates the installed brush member in an oscillating or rotative motion to more effectively dislodge and remove debris from areas that are normally difficult to clean such as the interior tip of a baby bottle nipple.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
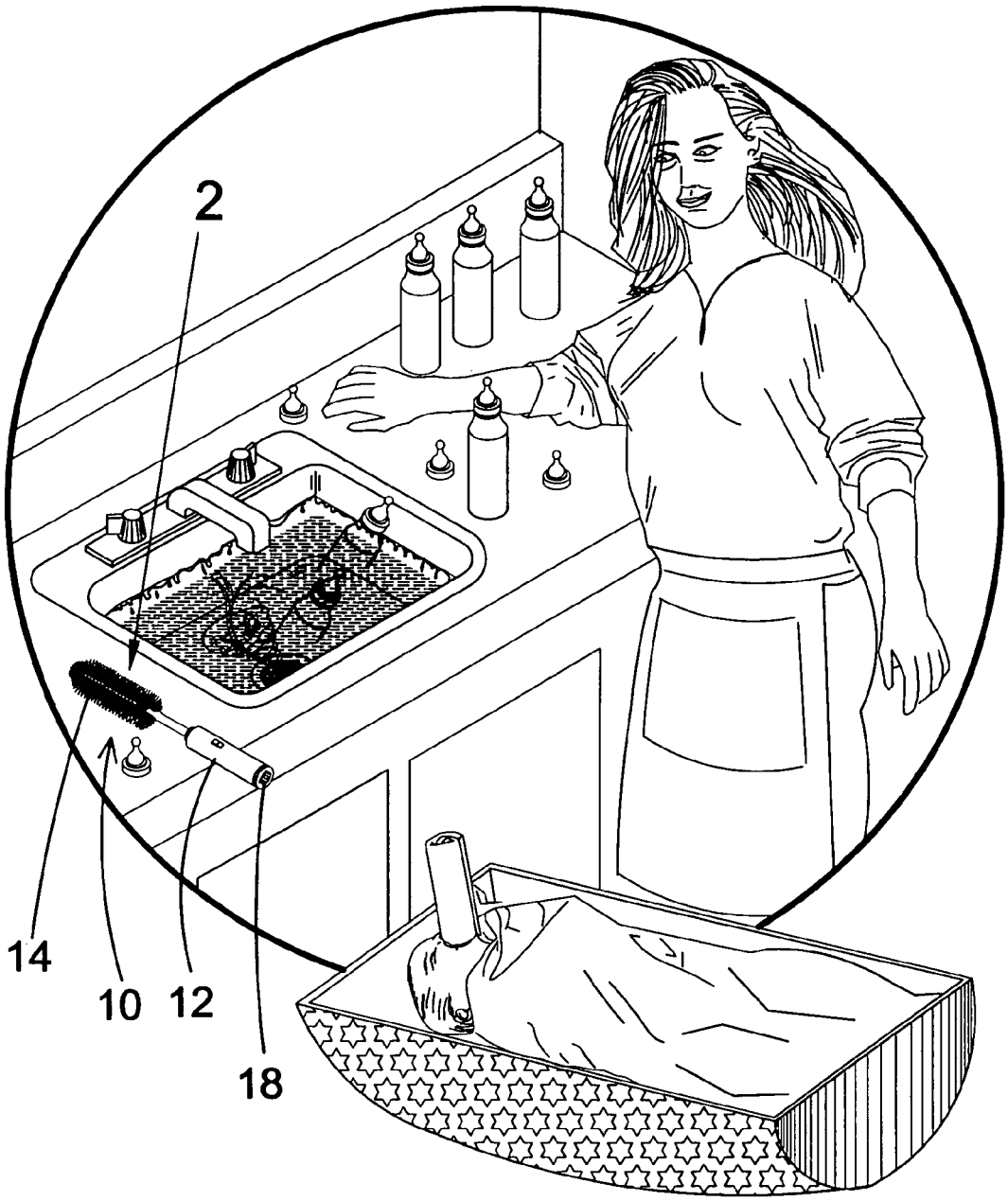
FIG. 1 is an illustrative view of the present invention in use.

With regard to reference numerals used, the following numbering is used throughout the drawings.

10 present invention
12 handle
14 cleaning element
16 on/off switch
18 cap
20 contact
22 port
24 stem
26 protrusion
28 threaded end
30 threads
32 battery
34 motor
36 plate
38 nipple brush
40 bottle brush
42 oscillating affect
44 baby bottle
46 nipple
48 battery recharger
50 rest
52 decoration

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 disclosed a baby bottle cleaning apparatus consisting of a handle 12 that houses an oscillating element, operating from a battery power source and controlled in an on and off position by means of a switch. At one distal end of the handle 12 is a threaded cap 18 that houses the battery of the device. The bottom portion of the cap provides a recharging contact element. At the other distal end of the handle 12 is an opening to accept interchangeable cleaning brush elements 14.

Figure 2:
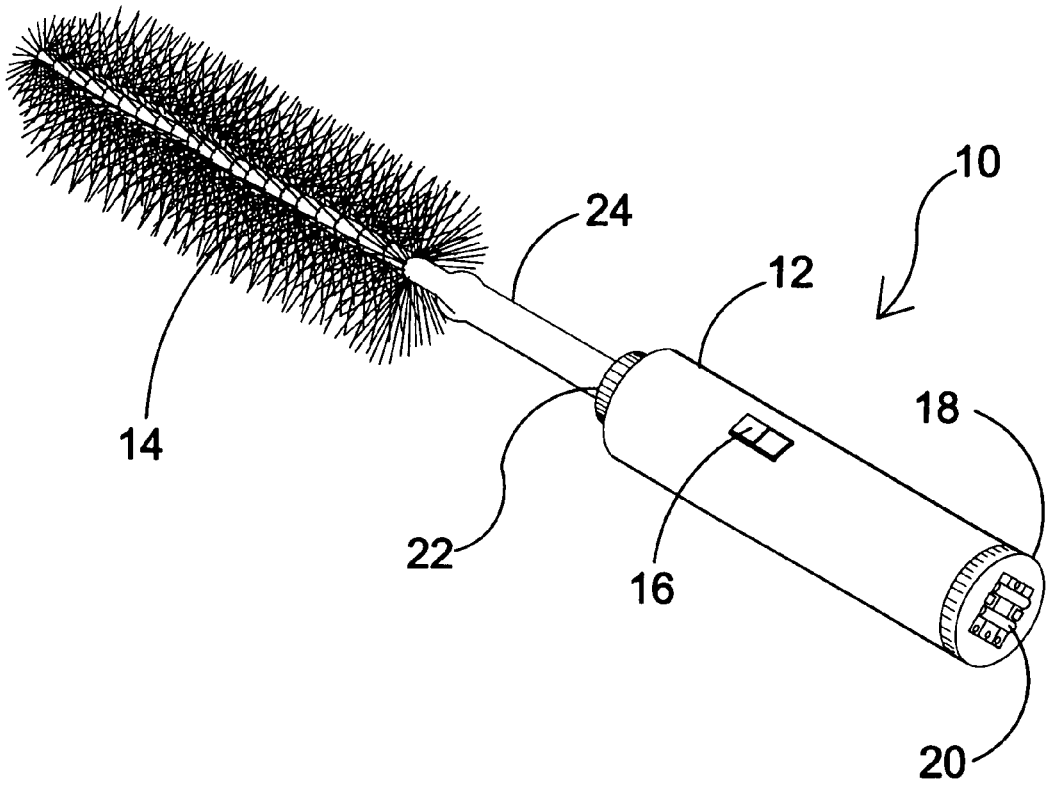
FIG. 2 is a perspective view of the present invention.

Turning to FIG. 2, shown therein is a perspective view of the present invention 10. The device of the present invention 10 discloses a battery operated, oscillating baby bottle cleaning brush consisting of a handle 12 with an on/off switch 16 and interchangeable brush heads 14. The removable threaded cap 18 portion of the device houses the battery and also provides a charging element with contacts 20 on its most bottom portion. Also shown are attachment port 22 and stem portion 24 of the brush 14.

Figure 3:
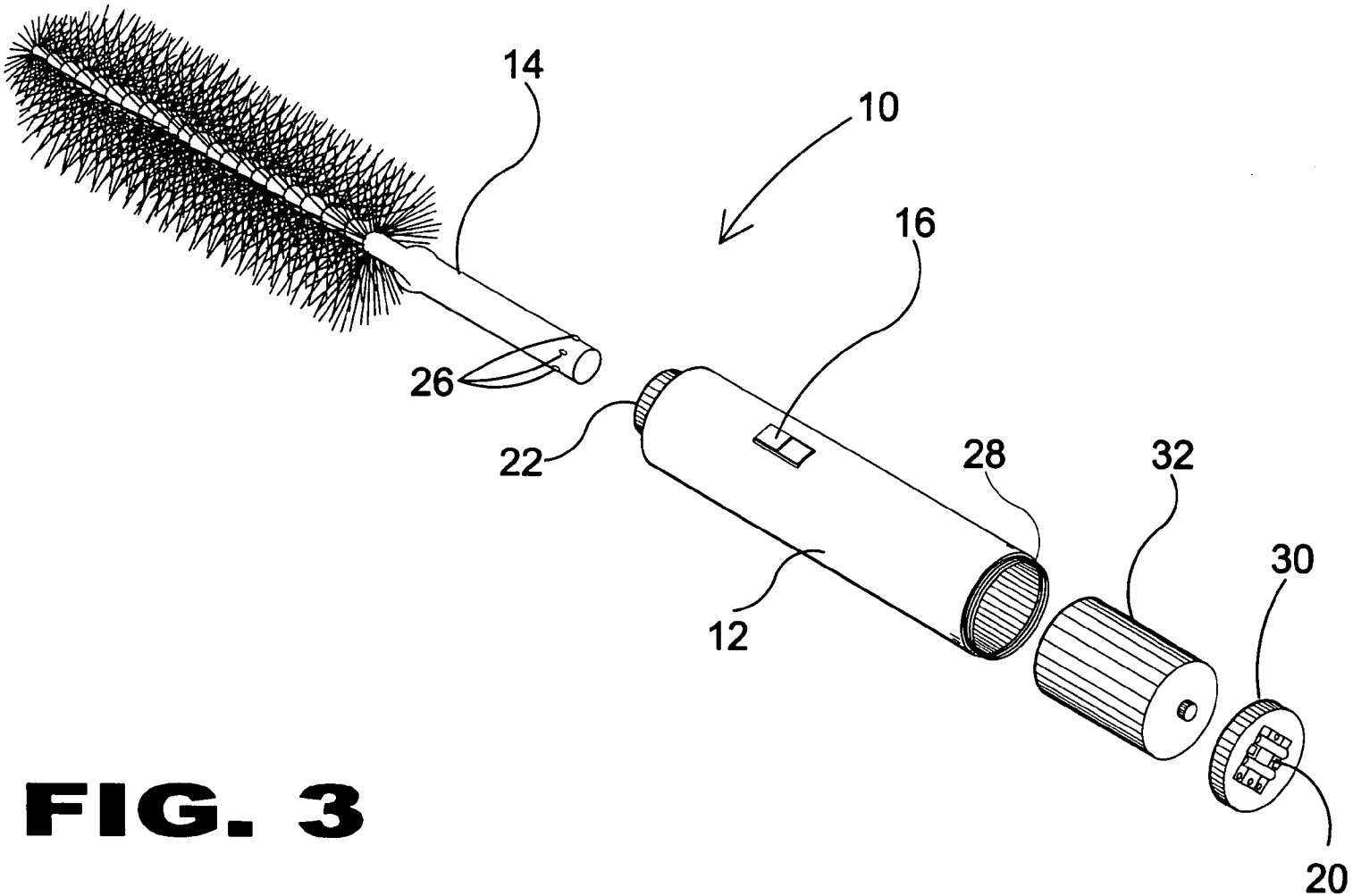
FIG. 3 is an exploded view of the present invention.

Turning to FIG. 3, shown therein is an exploded view of the present invention 10. Shown is an exploded view of the device of the present invention 10 having brush elements with the brush portion on one distal end and an attachment element with bump like protrusions or nubs 26 that provide a secure fit when placed within the port 22 of the device housing at the other distal end. Also shown are threaded end 28, threads 30 on cap, battery 32 along with other previously disclosed elements.

Figure 4:
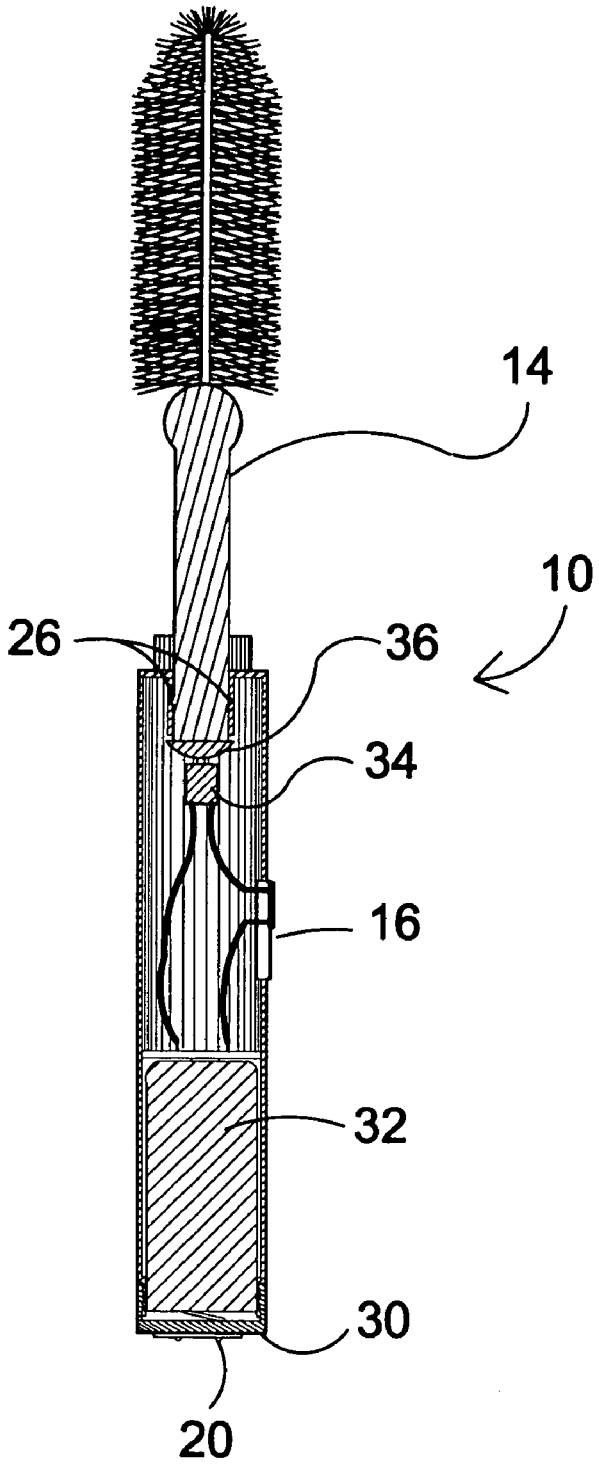
FIG. 4 is a sectional view of the present invention.

Turning to FIG. 4, shown therein is a sectional view of the present invention 10. Shown is the device of the present invention 10 with internal elements revealed. Shown are the oscillator motor 34 and oscillator plate 36 along with other previously disclosed elements.

Figure 5:
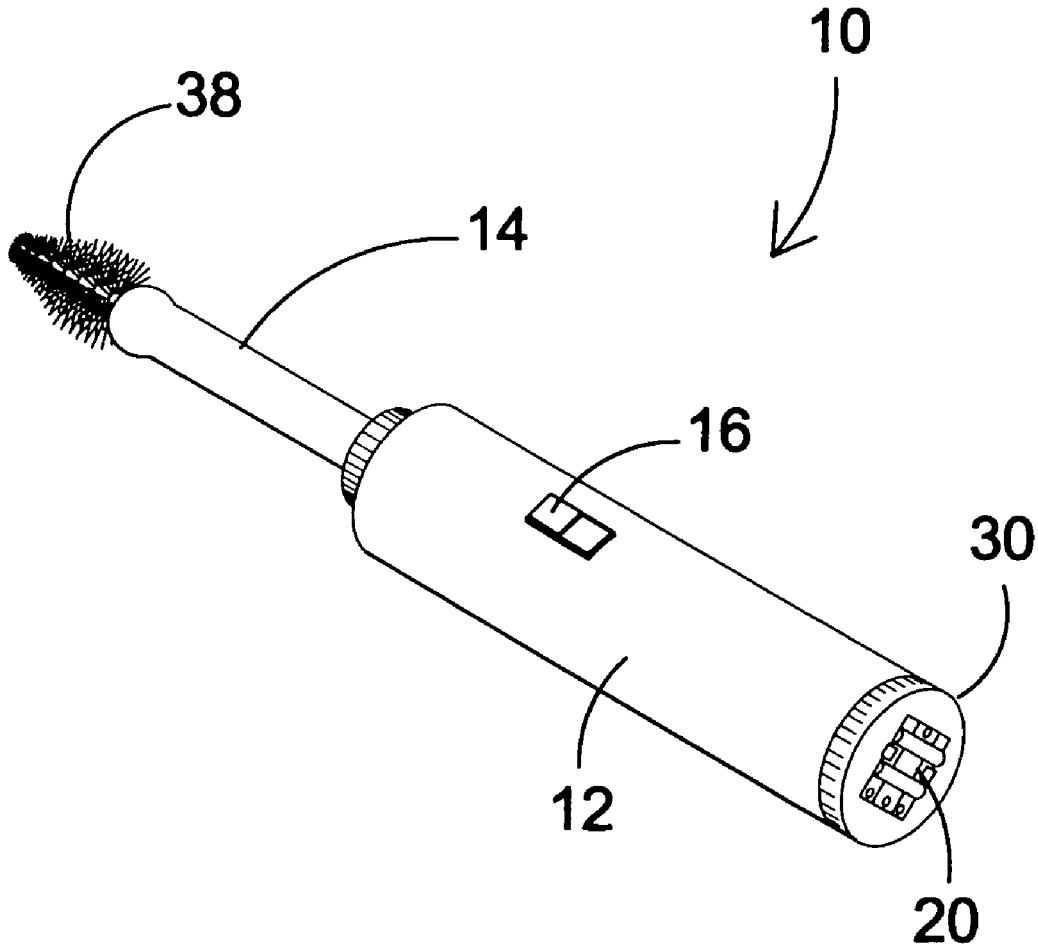
FIG. 5 is a perspective view of the present invention.

Turning to FIG. 5, shown therein is a perspective view of the present invention 10. Shown is the device of the present invention 10 having a baby bottle nipple-cleaning element 38 attached to the handle 12 portion of the device. The brush elements 14 are interchangeable and are provided in a plurality of styles. Other previously disclosed elements are also shown.

Figure 6:
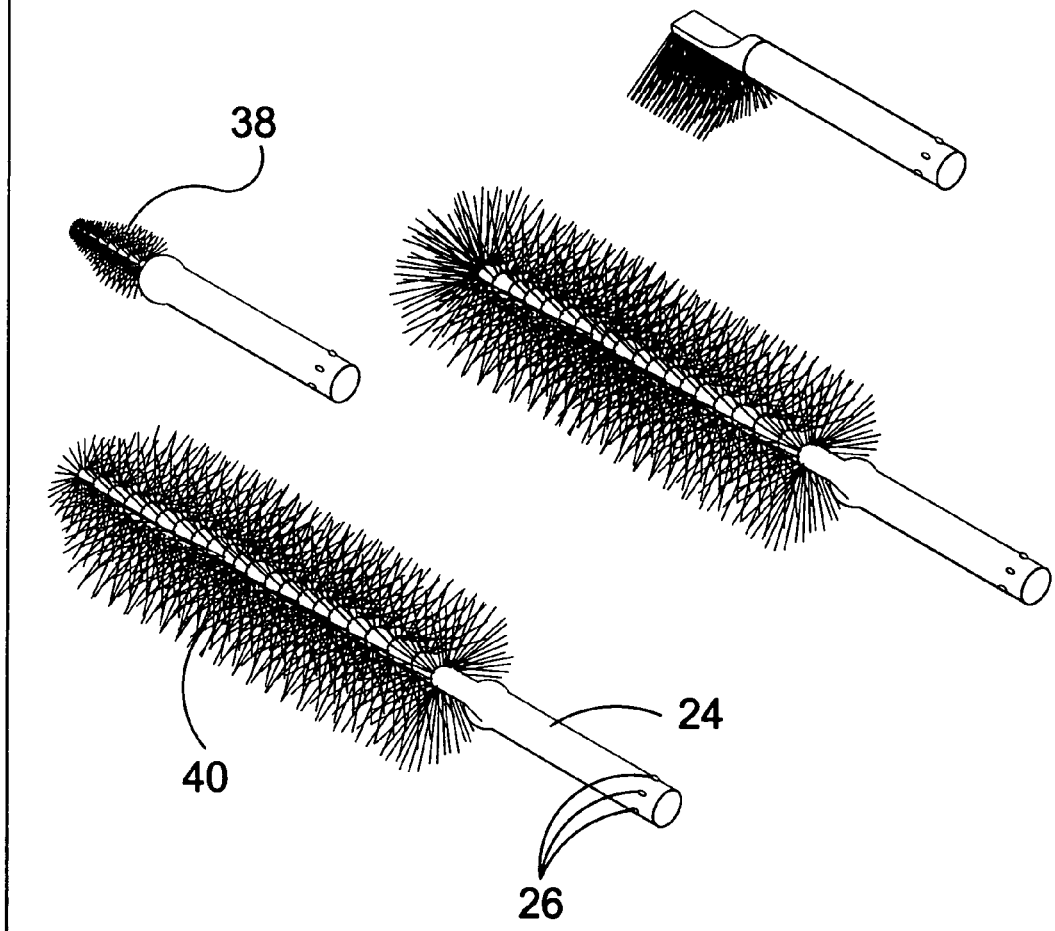
FIG. 6 is a perspective view of the present invention.

Turning to FIG. 6, shown therein is a perspective view of the present invention. Shown are some of the brush elements 14 that are interchangeable and attach to the handle portion of the device and secured to the handle by bump like protrusions 26 that interlock to a mating dent within the recessed portion of the handle. When attached within the handle port, the stem portion 24 is effectively sized to rests upon an oscillating plate that induces the oscillating effect to the brush portion, providing a scrubbing effect. Shown are a nipple brush 38 and bottle brush 40. Each brush is effectively sized for use with the article to be cleaned.

Figure 7:
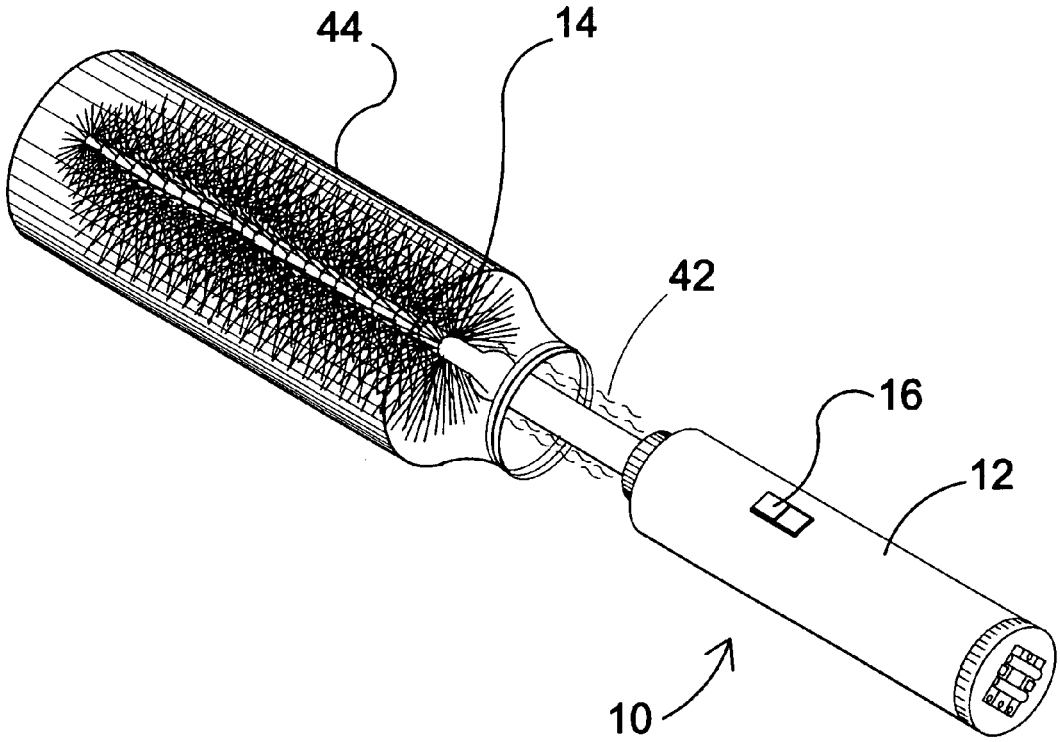
FIG. 7 is an illustrative view of the present invention in use.

Turning to FIG. 7, shown therein is an illustrative view of the present invention 10 in use. The present invention 10 discloses a baby bottle 44 cleaning apparatus, consisting of a handle 12 that houses an oscillating element producing oscillating affect 42, operating from a battery power source and controlled in an on and off position by means of a switch 16. At one distal end of the handle 12 is a threaded cap that houses the battery of the device. The bottom portion of the cap provides a recharging contact element. At the other distal end of the handle is an opening to accept interchangeable cleaning brush elements 14.

Figure 8:
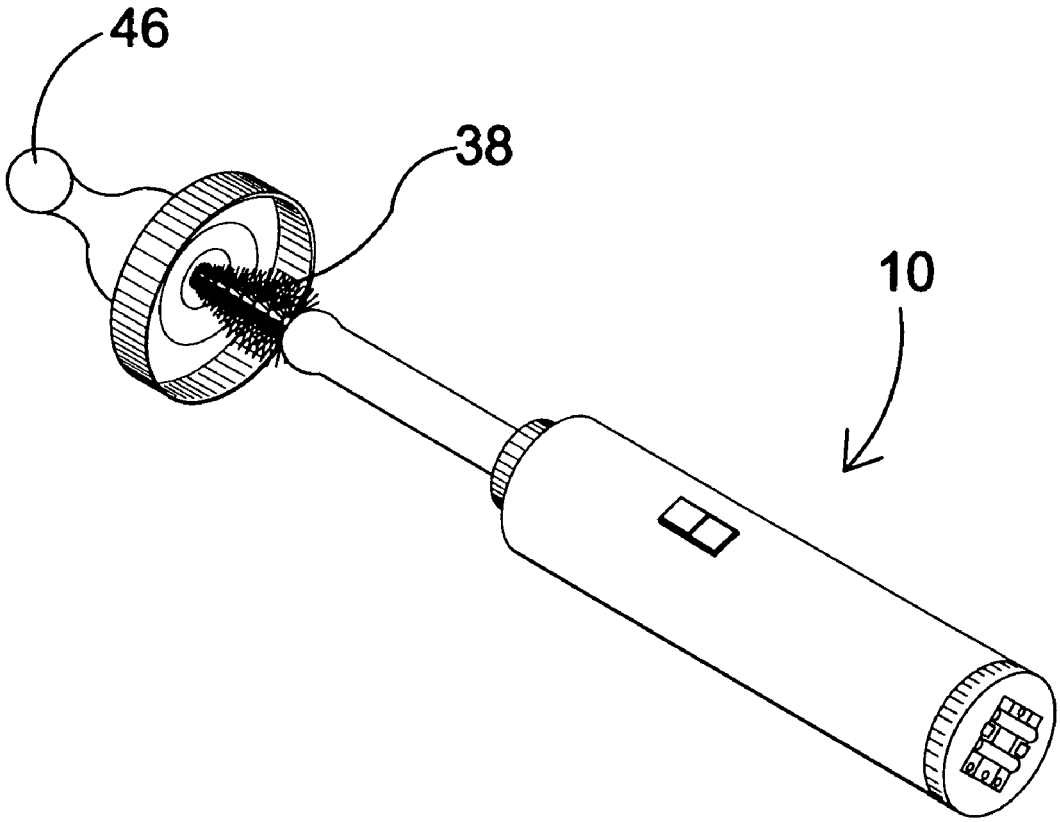
FIG. 8 is a perspective view of the present invention.

Turning to FIG. 8, shown therein is a perspective view of the present invention 10. Shown is the device of the present invention 10 having a baby bottle nipple-cleaning element 38 attached to the handle portion of the device. The brush elements are interchangeable and are provided in a plurality of styles. Also shown are nipple 46.

Figure 9:
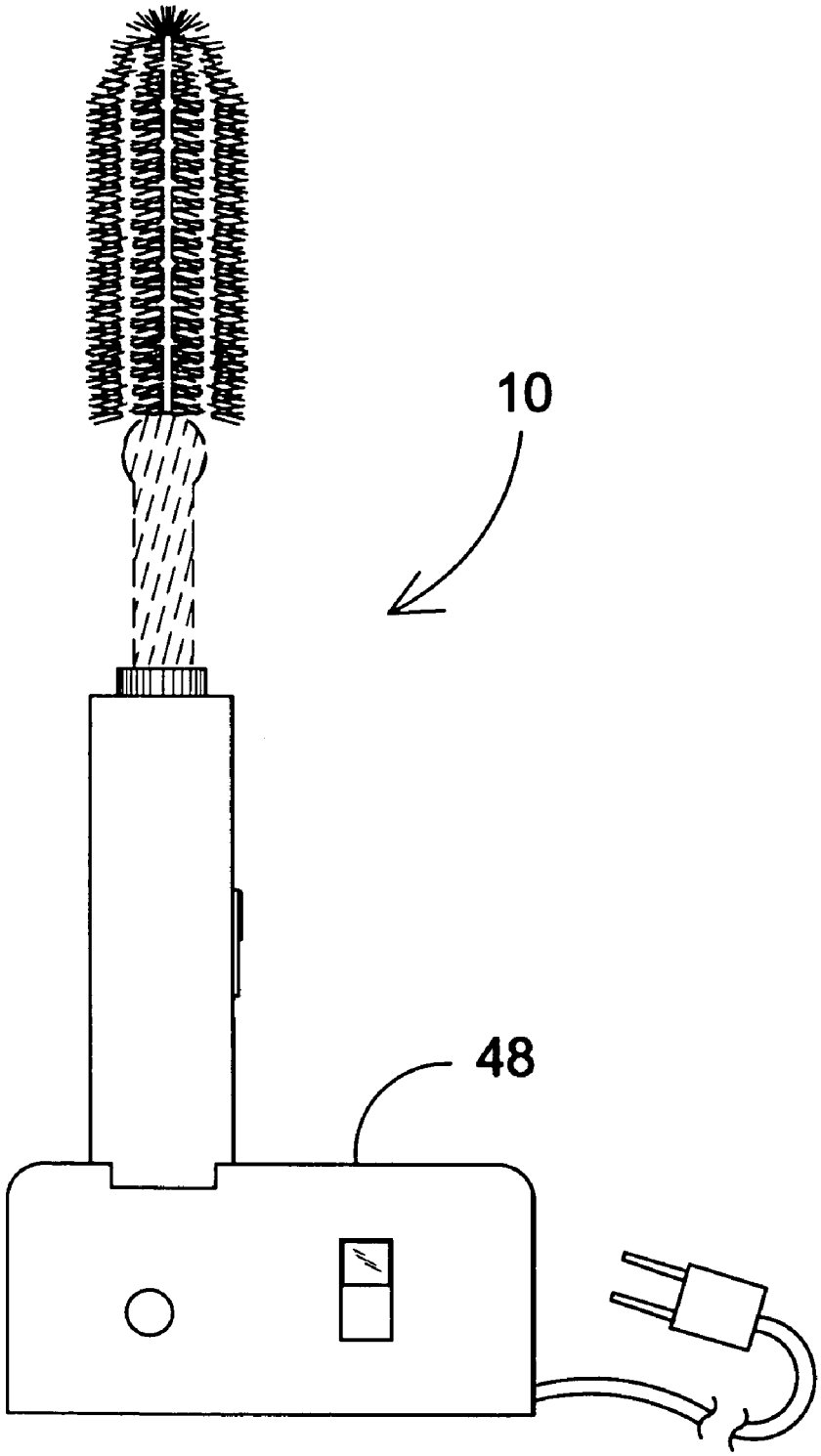
FIG. 9 is a view of the present invention with battery recharger.

Turning to FIG. 9, shown therein is a view of the present invention 10 with battery recharger 48. The present invention 10 provides a rechargeable battery operated system. The device 10 can be placed into a charger 48 and stand upright as it charges.

Figure 10:
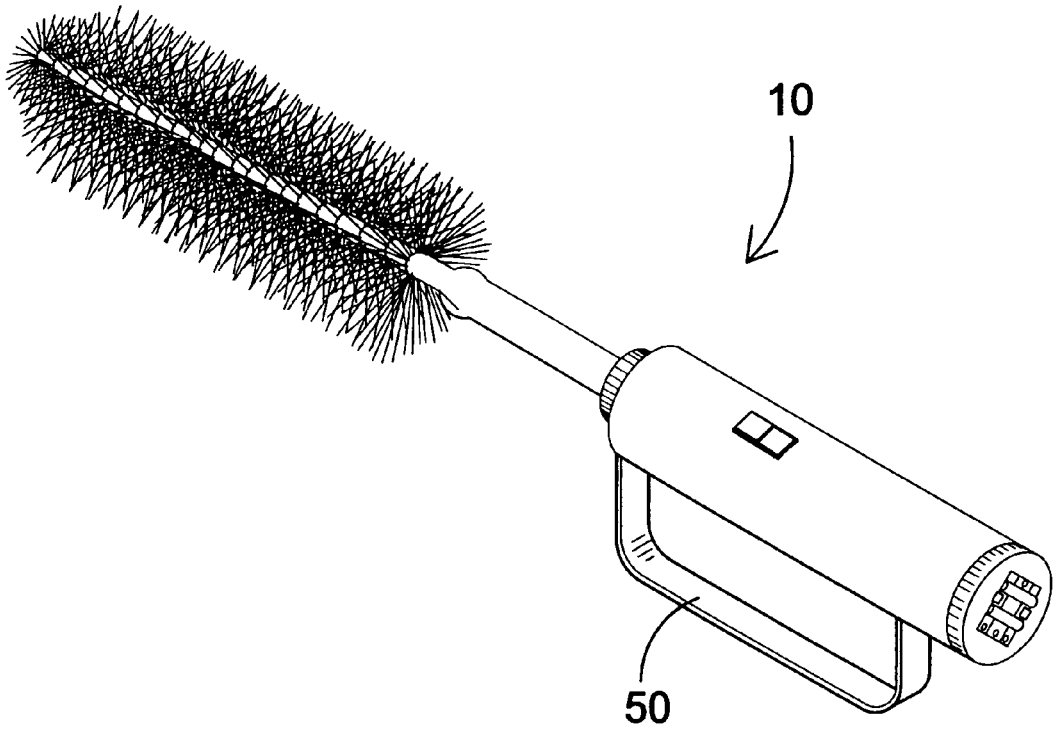
FIG. 10 is an alternate embodiment of the present invention.

Turning to FIG. 10, shown therein is an alternate embodiment of the present invention 10. An alternate embodiment of the present invention consists of the same components as the preferred version only provides a handle like rest 50 to place the device on a flat surface while not in use.

Figure 11:
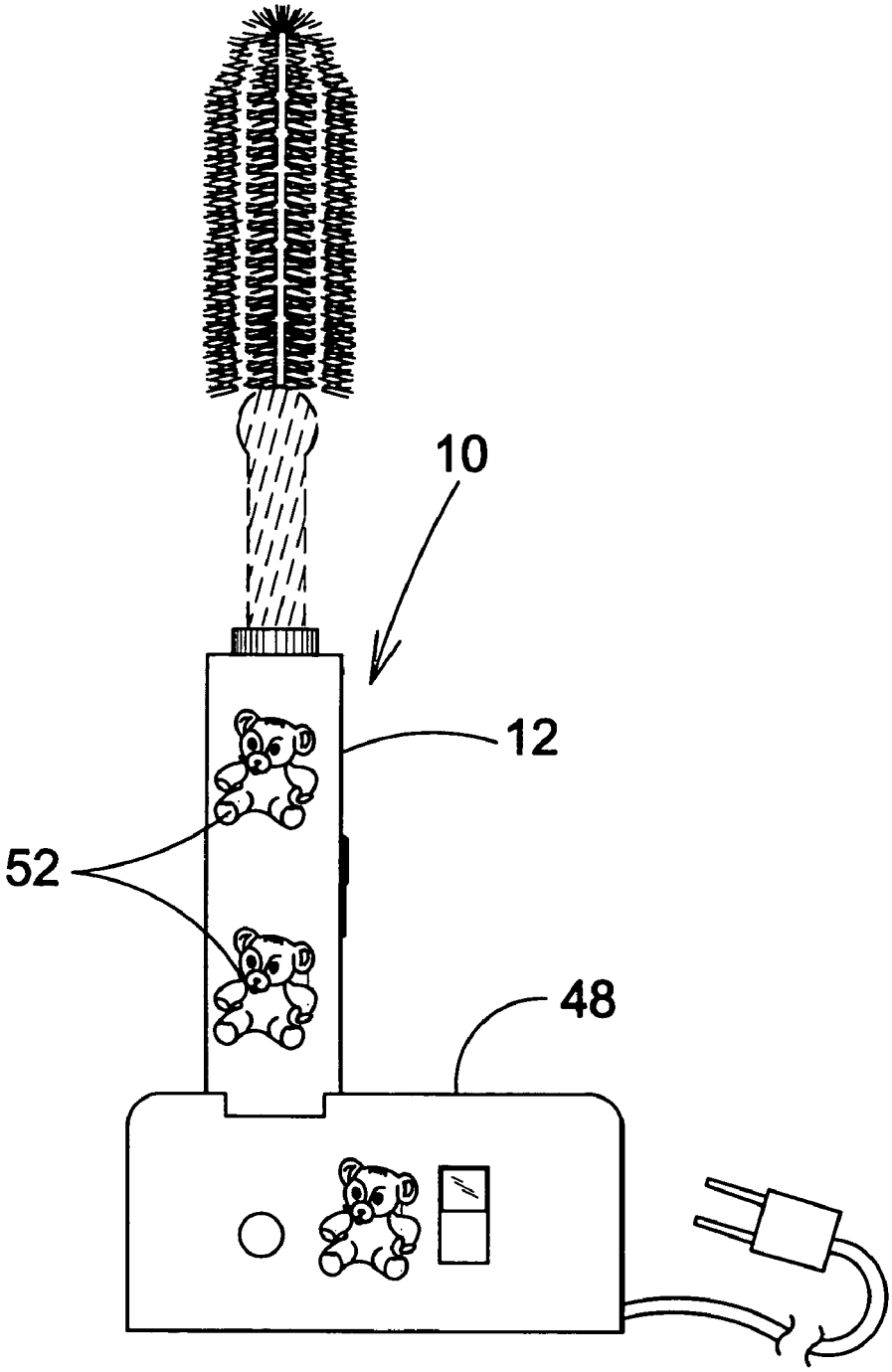
FIG. 11 is a view of the present invention demonstrating one of the possible decorations.

Turning to FIG. 11, shown therein is a view of the present invention 10 demonstrating one of the possible decorations. The present invention 10 may be available in any number of colors such as child friendly soft pastels. Decorative figures such as teddy bears 52, clowns, cartoon characters and the like may also adorn the handle 12 and/or charger 48.

I claim:

1. An apparatus for cleaning baby bottles and nipples therefor, comprising:

a) a handle having first and second ends, said first end having an opening therein;

b) a cleaning element having first and second ends, wherein a selected brush is disposed on said first end of said cleaning element for use in cleaning either a baby bottle or a nipple therefor, a stem being disposed on said second end of said cleaning element, said stem having a terminal end defining a flat surface received within said opening, said stem further having nubs mounted on an outer surface thereof for engagement with said handle within said opening;

c) an electric motor being disposed in said handle for oscillating said cleaning element, said electric motor having first and second ends, an oscillator plate having an upper flat surface and a lower convex surface, said lower convex surface being disposed on said first end of said motor, wherein said flat surfaces engage one another so that said cleaning element is oscillated by oscillation motion of said plate; and, d) means for receiving and applying a potential to said electric motor whereby the electric motor can be powered.

2. The apparatus of claim 1, wherein said means for receiving and applying a potential comprises a compartment being disposed in said handle, a battery being disposed in said compartment for applying a potential to said electric motor.

3. The apparatus of claim 2, wherein said handle is cylindrically shaped.

4. The apparatus of claim 3, further comprising a removable cap disposed on said second end of said handle, wherein said cap is removably attached to said handle using mating threads.

5. The apparatus of claim 4, further comprising electrical contacts being disposed on the outside of said cap for connection to a battery charger.

6. The apparatus of claim 5, further comprising an on/off switch being disposed on an outside of said handle for turning said motor on and off.

7. The apparatus of claim 6, wherein said nubs are used to removably attach said cleaning element to said handle.

8. The apparatus of claim 7, wherein said handle is adapted to be inserted into a battery charger so that said battery can be recharged.

9. The apparatus of claim 8, further comprising a decoration being disposed on said handle so that said handle is aesthetically pleasing to an observer.

* * * * *